US009953778B2

(12) United States Patent
Hashimoto et al.

(10) Patent No.: US 9,953,778 B2
(45) Date of Patent: Apr. 24, 2018

(54) GAS CIRCUIT BREAKER AND BREAKER FOR GAS INSULATED SWITCHING DEVICE

(71) Applicant: HITACHI, LTD., Tokyo (JP)

(72) Inventors: Hiroaki Hashimoto, Tokyo (JP); Takashi Iida, Tokyo (JP); Shunta Mori, Tokyo (JP); Kenichi Okubo, Tokyo (JP)

(73) Assignee: HITACHI LTD., Tokyo (JP)

( * ) Notice: Subject to any disclaimer, the term of this patent is extended or adjusted under 35 U.S.C. 154(b) by 0 days.

(21) Appl. No.: 15/493,795

(22) Filed: Apr. 21, 2017

(65) Prior Publication Data

US 2017/0309428 A1 Oct. 26, 2017

(30) Foreign Application Priority Data

Apr. 22, 2016 (JP) ..... 2016-086289

(51) Int. Cl.
*H01H 33/64* (2006.01)

(52) U.S. Cl.
CPC ..... *H01H 33/64* (2013.01); *H01H 2235/01* (2013.01)

(58) Field of Classification Search
CPC .. H01H 71/04; H01H 1/20; H01H 2071/0278; H01H 21/16; H01H 71/08; H01H 71/125; H01H 71/20; H01H 83/10; H01H 83/12; H01H 85/0241; H01H 9/10; H01H 9/102; H01H 9/104; H01H 9/282; H01H 2071/044
See application file for complete search history.

(56) References Cited

U.S. PATENT DOCUMENTS 5,059,753 A * 10/1991 Hamm ..... H01B 17/26 218/84
5,448,030 A * 9/1995 Yamamoto ..... H01H 33/40 218/1
6,437,276 B1 8/2002 Bruchmann et al.
7,078,643 B2 * 7/2006 Rostron ..... H01H 33/166 218/144
2013/0161289 A1 * 6/2013 Horinouchi ..... H01H 33/86 218/47

(Continued)

FOREIGN PATENT DOCUMENTS

JP 2002-536796 10/2002
JP 2005-228713 8/2005

(Continued)

*Primary Examiner* — Truc Nguyen
(74) *Attorney, Agent, or Firm* — Volpe and Koenig, P.C.

(57) ABSTRACT

A gas circuit breaker includes a breaking unit tank incorporating a fixed electrode and a movable electrode, a spring operation device including a breaking spring and a closing spring and configured to move the movable electrode, and a mechanism unit configured to couple the movable electrode side and the spring operation device side and transmit power received from the spring operation device to the movable electrode. The spring operation device is supported by a frame. The frame is fixed to a rear plate provided in a mechanism unit frame of the mechanism unit. A breaking spring case and a closing spring case of the spring operation device are fixed to pedestals via a plate member 38 and a support section 7.

10 Claims, 5 Drawing Sheets

(56) References Cited

U.S. PATENT DOCUMENTS

| | | | | |
|---|---|---|---|---|
| 2014/0209569 | A1* | 7/2014 | Miyatake | H01H 33/662 218/134 |
| 2014/0231391 | A1 | 8/2014 | Iwasawa et al. | |
| 2015/0136739 | A1* | 5/2015 | Hashimoto | H01H 33/40 218/78 |
| 2015/0244158 | A1* | 8/2015 | Fukuoka | H01B 17/26 218/139 |
| 2016/0071669 | A1* | 3/2016 | Haehnel | H01H 50/023 218/154 |
| 2016/0141126 | A1* | 5/2016 | Kikuchi | B22F 3/02 218/127 |

FOREIGN PATENT DOCUMENTS

| | | | |
|---|---|---|---|
| JP | 2010-080412 | A | 4/2010 |
| JP | 2013-065480 | A | 4/2013 |
| JP | 2015-097140 | A | 5/2015 |

* cited by examiner

GAS CIRCUIT BREAKER AND BREAKER FOR GAS INSULATED SWITCHING DEVICE

BACKGROUND OF THE INVENTION

1. Field of the Invention

The present invention relates to a gas circuit breaker and a circuit breaker for a gas insulated switching device.

2. Description of the Related Art

A gas insulated switching device including a bus container is a device that is disposed between a three-phase high-voltage power supply and an air power transmission line in a substation or the like and detects an abnormal current such as a lightening surge and shuts off an electric current. The gas insulated switching device is configured by a bushing that receives electric power from the three-phase high-voltage power supply, a gas circuit breaker, a bus container that houses a three-phase collective bus conductor gas-insulated to distribute electric power from the bushing to the gas circuit breaker, a disconnecting switch, an earthing device, and the like.

In recent years, a spring operation device, a driving source of which is a metal spring, is extensively applied to a gas circuit breaker used in a high-voltage power system. This is because oil is likely to leak from an accumulator, a hydraulic pump, and the like in a hydraulic operation device applied in the past.

As background art in this technical field applied with the spring operation device, there are JP-A-2015-097140 (Patent Literature 1), JP-A-2013-065480 (Patent Literature 2), JP-A-2010-080412 (Patent Literature 3), JP-A-2005-228713 (Patent Literature 4), and JP-T-2002-536796 (Patent Literature 5). Patent Literature 1 mentions that "a cylindrical breaking spring case 34 and a closing spring case 35 connected to a side of a mechanism unit 15 are fixed to a common pedestal 1 by legs 10*d*".

Patent Literature 2 mentions that "a breaking spring 12 and a closing spring 13 are provided in an upper part of a housing 14 as a breaking driving source of an operation mechanism 10".

Patent Literature 3 mentions that "a breaking operation unit 403 including a breaking spring 26 and a closing control mechanism 402 that holds and opens a closing spring 28 are housed in a spring operation mechanism 400 in an operation box 104, and the breaking spring 26 and the closing spring 28 are attached in lower parts".

Patent Literature 4 mentions that "respective one ends of a breaking spring 44 and a closing spring 42 are fixed to a frame lower part of a circuit breaker and respective other ends of the breaking spring 44 and the closing spring 42 are supported by a spring seat plate 70 and a spring seat plate 71".

Patent Literature 5 mentions that "a driving case 25 is provided under a circuit breaker case 11, a spring driving device 26 including closing and breaking springs is housed in the driving case 25, and the respective springs are configured to extend in the vertical direction".

A gas circuit breaker is configured from a breaking unit tank, a spring operation device, a mechanism unit, and the like. For example, Patent Literature 5 describes a structure in which a part of the spring operation device is fixed to a flange of the mechanism unit. However, the techniques described in Patent Literatures 1 to 5 do not take into account a deficiency in which the entire spring operation device vibrates according to an extending motion of a spring functioning as a driving source and efficiency of transmission of a driving force to a movable electrode of the breaking unit tank via the mechanism unit is deteriorated.

SUMMARY OF THE INVENTION

Therefore, an object of the present invention is to provide a gas circuit breaker and a circuit breaker for a gas insulated switching device having high efficiency of transmission of a driving force to a movable electrode of a breaking unit tank.

According to an aspect of the present invention, there is provided a gas circuit breaker including: a breaking unit tank incorporating a fixed electrode and a movable electrode; a spring operation device including a breaking spring and a closing spring and configured to move the movable electrode; a mechanism unit configured to couple the movable electrode side and the spring operation device side and transmit power received from the spring operation device to the movable electrode; a supporting member configured to support the spring operation device; and a vibration suppressing unit configured to suppress vibration of the spring operation device. The supporting member is provided in the mechanism unit.

According to the present invention, it is possible to provide a gas circuit breaker and a circuit breaker for a gas insulated switching device having high efficiency of transmission of driving energy to a movable electrode of a breaking unit tank.

Problems, configurations, and effects other than those explained above are clarified by the following explanation of an embodiment.

DETAILED DESCRIPTION OF THE INVENTION

Embodiments of the present invention are explained below with reference to the drawings.

First Embodiment

Figure 1:
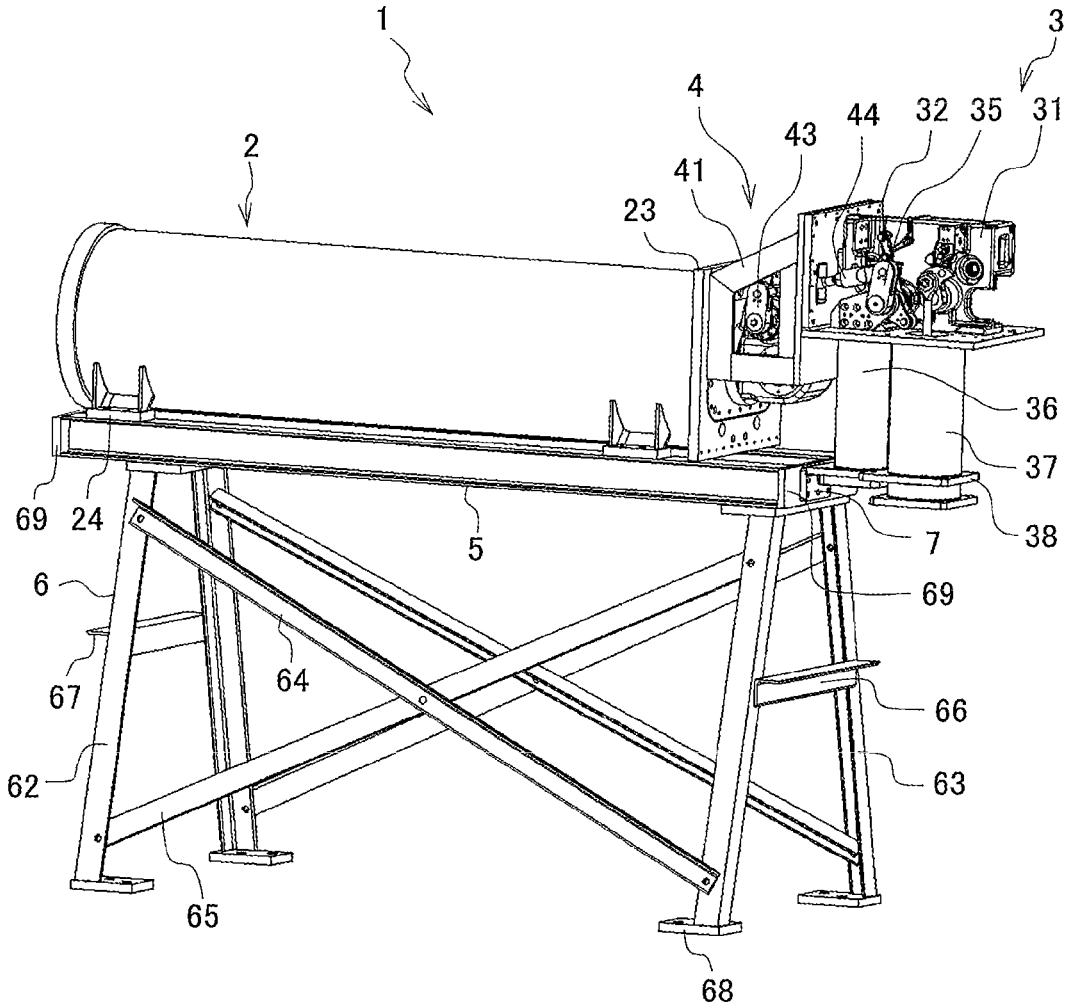
FIG. 1 is a perspective view of an exterior of a gas circuit breaker according to a first embodiment of the present invention.

FIG. 1 is a perspective view of an exterior of a gas circuit breaker according to a first embodiment of the present invention.

Figure 2:
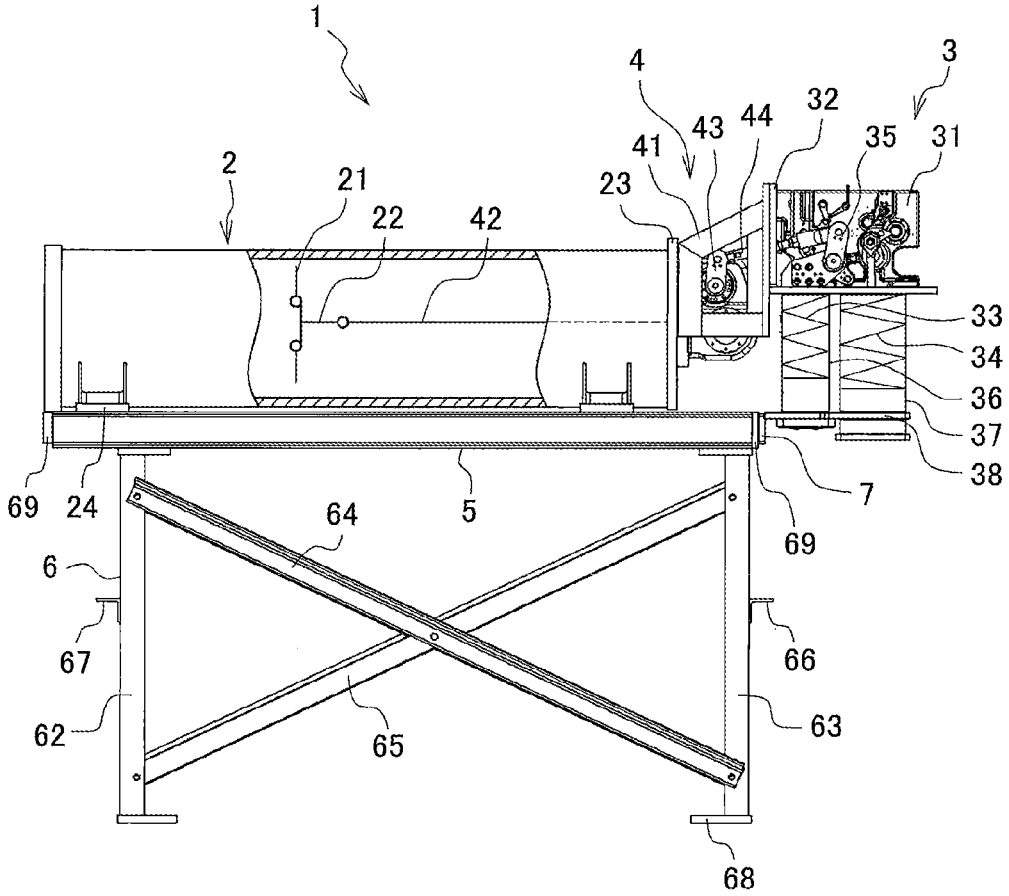
FIG. 2 is a partially cut-off side view showing electrodes and the like on the inside of a breaking unit tank in the gas circuit breaker according to the first embodiment of the present invention.
Figure 3:
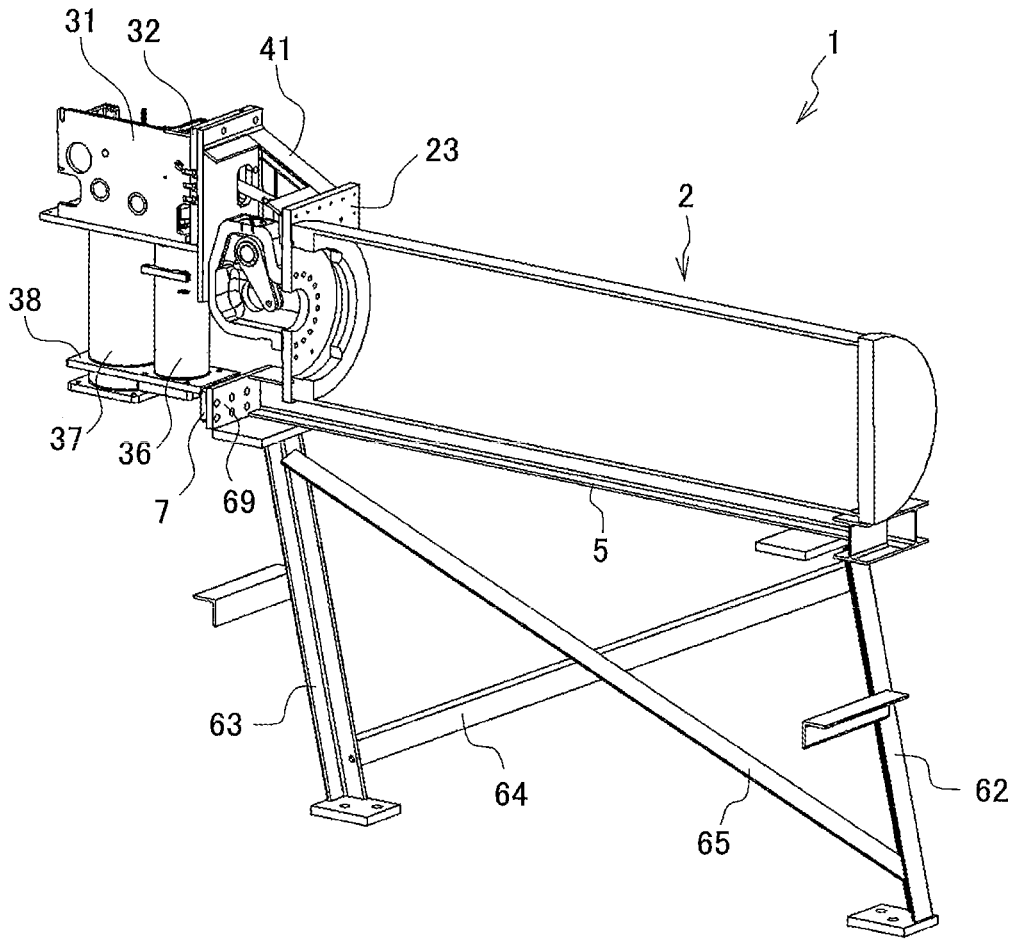
FIG. 3 is a perspective view of the breaking unit tank vertically cut in a longitudinal direction in the gas circuit breaker according to the first embodiment of the present invention.

FIG. 2 is a partially cut-off side view showing electrodes and the like on the inside of a breaking unit tank in the gas circuit breaker. FIG. 3 is a perspective view of the breaking unit tank vertically cut in a longitudinal direction in the gas circuit breaker.

A gas circuit breaker 1 includes a breaking unit tank 2, a spring operation device 3, a mechanism unit 4, pedestals 5, and legs 6.

The breaking unit tank 2 is, for example, a cylindrical member. A fixed electrode 21 and a movable electrode 22 that moves to come into a contact or non-contact state with the fixed electrode 21 are provided on the inside of the breaking unit tank 2 (FIG. 2). Insulative gas is encapsulated on the inside of the breaking unit tank 2. The breaking unit tank 2 is disposed with a length direction of a cylinder set as a horizontal direction.

The mechanism unit 4 is housed in a mechanism unit frame 41 and provided in a flange 23 provided at one end portion in the longitudinal direction of the breaking unit tank 2. The mechanism unit 4 is supported by the breaking unit tank 2. The spring operation device 3 is provided on the opposite side of the breaking unit tank 2 in the longitudinal direction of the breaking unit tank 2 across the mechanism unit 4. The spring operation device 3 is housed in a frame (a supporting member) 31 and fixed to a rear plate 32 provided on the opposite side of the breaking unit tank 2 across the mechanism unit frame 41. Specifically, one surface of the rear plate 32 is fastened to the mechanism unit frame 41.

The spring operation device 3 includes a breaking spring 33 and a closing spring 34 (FIG. 2) and moves the movable electrode 22 using the breaking spring 33 and the closing spring 34 as power sources. The mechanism unit 4 couples the movable electrode 22 side and the spring operation device 3 side and transmits power received from the spring operation device 3 to the movable electrode 22.

The breaking unit tank 2 is fixed to the pedestals 5 via tank leg sections 24. The pedestals 5 support the breaking unit tank 2. The pedestals 5 are supported by the legs 6 assembled by, for example, pieces of L-shaped steel 62 to 68. The legs 6 are fixed to the ground. Left and right two pedestals 5 are provided under the breaking unit tank 2 with the longitudinal direction of the breaking unit tank 2 set as a longitudinal direction. The two pedestals 5 support the breaking unit tank 2. Connecting members 69 connect the two pedestals 5.

In the mechanism unit 4, a rod 42 (FIG. 2) and a lever 43 for driving the movable electrode 22 are provided. A rod 44 for transmitting a driving force received from the spring operation device 3 is connected to the lever 43. One end of the rod 44 is connected to a lever 35 in the spring operation device 3. The lever 35 is connected to the breaking spring 33 by a not-shown breaking spring rod. The lever 35 is rotatably supported by the frame 31 in the spring operation device 3.

The breaking spring 33 is housed in a cylindrical breaking spring case 36. The closing spring 34 is housed in a cylindrical closing spring case 37.

The pedestals 5 horizontally extend to the vicinity of the spring operation device 3, the spring cases 36 and 37 are coupled by a plate member (a fixing member) 38, and a support section (a fixing member) 7 provided at one end of the plate member 38 is connected to the connecting member 69 to fix the spring operation device 3 to the pedestals 5. As shown in FIGS. 1 to 3, pluralities of holes are provided in both of the support section 7 and the connecting member 69 to fasten the support section 7 and the connecting member 69 with bolts. Consequently, the support section (the fixing member) 7 (and the plate member 38) realizes a vibration suppressing unit. The support section 7 fixes the breaking spring case 36 to the pedestals 5 via the plate member 38. The breaking spring case 36 is disposed on the mechanism unit 4 side of the spring operation device 3. The closing spring case 37 is disposed on the opposite side of the mechanism unit 4.

The operation of the gas circuit breaker 1 is explained.

In FIG. 2, the breaking spring 33 and the closing spring 34 are in a compressed state. A contact point of the fixed electrode 21 and the movable electrode 22 is in a closed state. When an open-circuit command is input to the gas circuit breaker 1, a not-shown publicly-known breaking control mechanism in the spring operation device 3 operates. The breaking spring 33 extends in a downward direction. The lever 35 rotates counterclockwise using the operation of the breaking spring 33 as a power source. The movement of the lever 35 is transmitted via the rod 44, the lever 43, and the rod 42 to separate the movable electrode 22 from the fixed electrode 21.

Subsequently, when a closed-circuit command is input to the gas circuit breaker 1, a not-shown publicly-known closing control mechanism in the spring operation device 3 operates to extend the closing spring 34 in the downward direction. Then, the lever 35 rotates clockwise using the extending operation of the closing spring 34 as a power source to insert the movable electrode 22 into the fixed electrode 21 and compress the breaking spring 33 again.

Thereafter, the closing spring 34 fully extended by the closed-circuit operation is compressed again by a publicly-known electric motor and a publicly-known reduction gear not shown in the figure in the spring operation device 3. The closing spring 34 extends at high speed according to the closed-circuit operation. In the recompression of the closing spring 34, in general, the closing spring 34 operates for ten seconds to fifteen seconds. On the other hand, the breaking spring 33 operates at high speed in both of the opening operation and the closing operation of the gas circuit breaker 1.

In this embodiment, the frame 31 is fixed to the rear plate 32. Even if the breaking spring 33 operates at high speed in the breaking spring case 36, since the breaking spring case 36 is fixed to the pedestals 5 by the support section 7, vibration in a vertical direction of the breaking spring case 36 is suppressed. Therefore, it is possible to improve driving efficiency of the spring operation device 3 and the mechanism of the mechanism unit 4 during the open-circuit operation.

Even if the closing spring 34 operates at high speed in the closing spring case 37 in the closed-circuit operation, vibration in the vertical direction of the closing spring case 37 is suppressed by the plate member 38 and the support section 7. Therefore, it is also possible to improve driving efficiency of the spring operation device 3 and the mechanism of the mechanism unit 4 during the closed-circuit operation.

Figure 4:
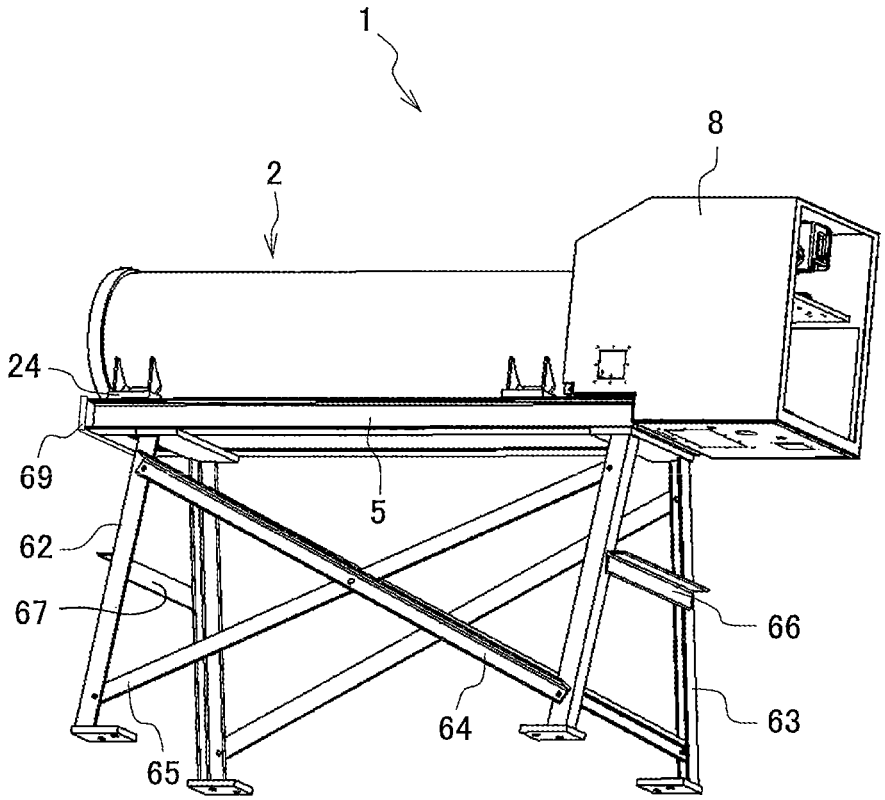
FIG. 4 is a perspective view showing a state in which an operation box is attached to the gas circuit breaker according to the first embodiment of the present invention.

Further, as shown in FIG. 4, an upper side and sides of a bolt fastening section of the support section 7 and the connecting member 69 are covered by an operation box (a covering member) 8. Therefore, even if the gas circuit breaker 1 is set outdoor, water resistance can be secured and reliability of the bolt fastening section can be guaranteed.

Second Embodiment

Figure 5:
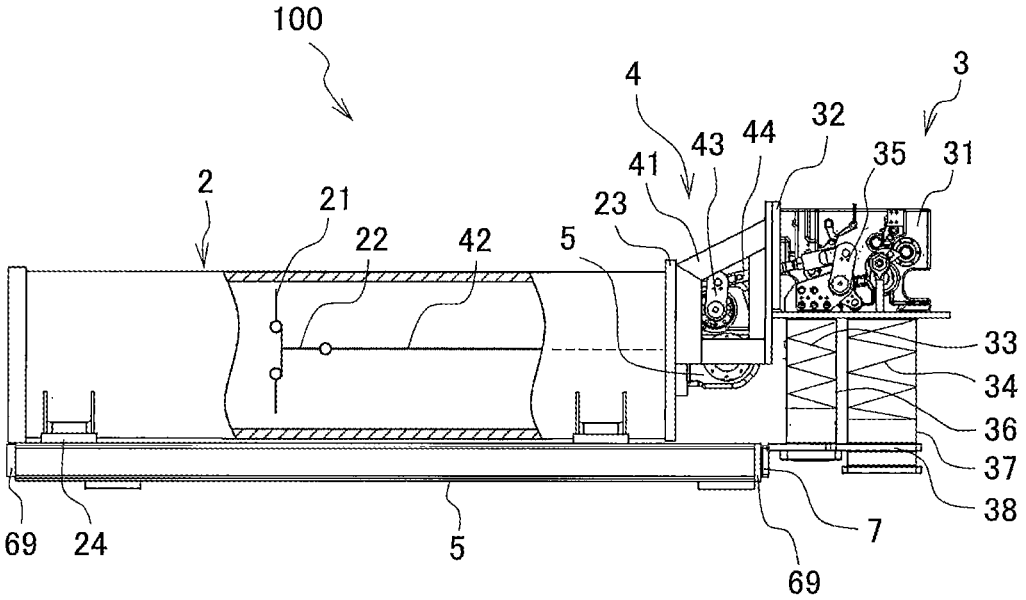
FIG. 5 is a partially cut-off side view showing electrodes and the like on the inside of a breaking unit tank in a circuit breaker for a gas insulated switching device according to a second embodiment of the present invention.

FIG. 5 is a partially cut-off side view showing electrodes and the like on the inside of a breaking unit tank in a circuit breaker for a gas insulated switching device according to a second embodiment of the present invention. In this embodiment, members and the like denoted by reference numerals and signs same as those in FIGS. 1 to 4 are the same as the members and the like in the first embodiment. Therefore, detailed explanation of the members and the like is omitted. A circuit breaker 100 for a gas insulated switching device in this embodiment is different from the gas circuit breaker in the first embodiment in that the legs 6 are not provided.

In this embodiment, as in the first embodiment, since the support section 7 is fastened to the pedestals 5, operation vibration of the spring operation device 3 is suppressed. Therefore, as in the first embodiment, it is possible to improve driving efficiency during opening and closing operation of the electrodes.

The lower ends of the spring cases 36 and 37 are present further on the upper side than the lower ends of the pedestals 5. Therefore, it is possible to directly dispose the pedestals 5 on the ground. It is possible to reduce the total height of the gas insulated switching device including the gas circuit breaker.

Note that the present invention is not limited to the embodiments explained above and includes various modifications. For example, the embodiments are explained in detail in order to clearly explain the present invention. The embodiments are not always limited to embodiments including all the configurations explained above. A part of configurations of a certain embodiment can be substituted with configurations of another embodiment. Configurations of another embodiment can be added to configurations of a certain embodiment. Other configurations can be added to, deleted from, and substituted with a part of the configurations of the embodiments.

What is claimed is:

1. A gas circuit breaker comprising:

a breaking unit tank incorporating a fixed electrode and a movable electrode;

a spring operation device including a breaking spring and a closing spring and configured to move the movable electrode, wherein the breaking spring is housed in a breaking spring case, the closing spring is housed in a closing spring case;

a mechanism unit configured to couple the movable electrode side and the spring operation device side and transmit power received from the spring operation device to the movable electrode;

a supporting member configured to support the spring operation device, such that both the breaking spring case and the closing spring case are disposed between the supporting member and a fixing member; and a vibration suppressing unit configured to suppress vibration of the spring operation device, wherein the supporting member is provided in the mechanism unit.

2. The gas circuit breaker according to claim 1, further comprising a pedestal configured to support the breaking unit tank, wherein the mechanism unit is provided at one end portion in a longitudinal direction of the breaking unit tank and supported by the breaking unit tank, the spring operation device is provided on an opposite side of the breaking unit tank in the longitudinal direction of the breaking unit tank across the mechanism unit, the pedestal extends to a vicinity of the spring operation device, and the vibration suppressing unit is the fixing member configured to fix the spring operation device and the pedestal.

3. The gas circuit breaker according to claim 1, wherein the breaking spring case is disposed on the mechanism unit side of the spring operation device.

4. The gas circuit breaker according to claim 2, wherein a cover member that covers the vibration suppressing unit is provided.

5. The gas circuit breaker according to claim 1, further comprising legs configured to support the pedestal under the pedestal.

6. A circuit breaker for a gas insulated switching device comprising:

a breaking unit tank incorporating a fixed electrode and a movable electrode;

a spring operation device including a breaking spring and a closing spring and configured to move the movable electrode, wherein the breaking spring is housed in a breaking spring case, the closing spring is housed in a closing spring case;

a mechanism unit configured to couple the movable electrode side and the spring operation device side and transmit power received from the spring operation device to the movable electrode;

a supporting member configured to support the spring operation device, such that both the breaking spring case and the closing spring case are disposed between the supporting member and a fixing member; and a vibration suppressing unit configured to suppress vibration of the spring operation device, wherein the supporting member is provided in the mechanism unit.

7. The circuit breaker for the gas insulated switching device according to claim 6, further comprising a pedestal configured to support the breaking unit tank, wherein the mechanism unit is provided at one end portion in a longitudinal direction of the breaking unit tank, the spring operation device is provided on an opposite side of the breaking unit tank in the longitudinal direction of the breaking unit tank across the mechanism unit, the pedestal extends to a vicinity of the spring operation device, and the vibration suppressing unit is the fixing member configured to fix the spring operation device and the pedestal.

8. The circuit breaker for the gas insulated switching device according to claim 7, wherein the breaking spring case is disposed on the mechanism unit side of the spring operation device.

9. The circuit breaker for the gas insulated switching device according to claim 7, wherein the spring operation device includes a closing spring case configured to house the closing spring, the fixing member fixes the closing spring case and the pedestal, and lower ends of the breaking spring case and the closing spring case are located further on an upper side than a lower end of the pedestal.

10. The circuit breaker for the gas insulated switching device according to claim 6, wherein a cover member that covers the vibration suppressing unit is provided.

* * * * *